US010299572B2

(12) United States Patent
Salentine et al.

(10) Patent No.: US 10,299,572 B2
(45) Date of Patent: May 28, 2019

(54) POUCH OR HOLSTER COUPLED WITH A RETRACTING DEVICE

(71) Applicant: HAMMERHEAD INDUSTRIES, INC., Ventura, CA (US)

(72) Inventors: John A Salentine, Goleta, CA (US); Kenneth S Collin, Jr., Ojai, CA (US)

(73) Assignee: HAMMERHEAD INDUSTRIES, INC., Ventura, CA (US)

( * ) Notice: Subject to any disclaimer, the term of this patent is extended or adjusted under 35 U.S.C. 154(b) by 0 days.

(21) Appl. No.: 13/741,578

(22) Filed: Jan. 15, 2013

(65) Prior Publication Data

US 2013/0181019 A1 Jul. 18, 2013

Related U.S. Application Data

(60) Provisional application No. 61/587,060, filed on Jan. 16, 2012.

(51) Int. Cl.

| | |
|---|---|
| ***A45F 5/00*** | (2006.01) |
| ***A45F 5/02*** | (2006.01) |
| *A45F 3/14* | (2006.01) |

(52) U.S. Cl.

CPC ..... *A45F 5/00* (2013.01); *A45F 5/021* (2013.01); *A45F 5/004* (2013.01); *A45F 5/02* (2013.01); *A45F 2003/146* (2013.01); *A45F 2005/006* (2013.01)

(58) Field of Classification Search

CPC .... A45F 5/00; A45F 5/02; A45F 5/004; A45F 5/021; A45F 2200/0516; A45F 2003/146; A45F 2005/006

USPC ..... 224/162, 242

See application file for complete search history.

(56) References Cited

U.S. PATENT DOCUMENTS

| | | | | |
|---|---|---|---|---|
| 1,213,758 | A * | 1/1917 | Delaney | A45C 13/185 150/106 |
| 2,793,617 | A * | 5/1957 | Palmer | B43K 23/001 224/162 |
| 4,300,665 | A * | 11/1981 | Arechaga | 191/12.4 |
| 4,486,169 | A * | 12/1984 | Lewis | F23Q 2/34 206/85 |
| 4,714,184 | A * | 12/1987 | Young | A45C 11/38 224/185 |
| 5,094,396 | A * | 3/1992 | Burke | 242/378.2 |
| 5,513,785 | A * | 5/1996 | Campagna, Jr. | 224/162 |
| 5,524,749 | A * | 6/1996 | Thompson | A45F 5/02 150/147 |
| 5,645,147 | A * | 7/1997 | Kovacik et al. | 191/12.2 R |
| 6,487,756 | B1 * | 12/2002 | Vidal, Jr. | 24/3.1 |
| 6,502,727 | B1 * | 1/2003 | Decoteau | A45F 5/004 224/162 |
| 6,966,519 | B2 | 11/2005 | Salentine et al. | |
| 7,478,776 | B2 | 1/2009 | Salentine et al. | |

(Continued)

*Primary Examiner* — Corey N Skurdal

(74) *Attorney, Agent, or Firm* — Ferguson Case Orr Paterson LLP

(57) ABSTRACT

Holstering retractor devices or systems for securing a device or instrument when not in use, such that the instrument does not have to be held or slid into a pocket. The systems are coupled with a retracting device, integrated into the holster, such that if said instrument or device pops out of holster, or is dropped while in use, it is not lost or damaged. The present invention is also directed to systems utilizing the holster retractors, such as vest system having the holster retractor mounted to the vests.

24 Claims, 3 Drawing Sheets

(56) References Cited

U.S. PATENT DOCUMENTS

| | | | | |
|---|---|---|---|---|
| 7,658,307 | B2 * | 2/2010 | Skupin | A45F 5/004 224/219 |
| 7,665,684 | B2 * | 2/2010 | Salentine et al. | 242/379.2 |
| 8,191,815 | B2 * | 6/2012 | Huang | 242/379 |
| 8,662,464 | B2 * | 3/2014 | Hand et al. | 248/329 |
| 2005/0115997 | A1 * | 6/2005 | Nouvel De La Fleche | 224/162 |
| 2009/0114687 | A1 * | 5/2009 | Wu et al. | 224/242 |
| 2010/0148028 | A1 * | 6/2010 | Hand et al. | 248/330.1 |
| 2010/0206976 | A1 * | 8/2010 | Salentine et al. | 242/379.2 |
| 2010/0326371 | A1 * | 12/2010 | Lopusnak et al. | 119/796 |
| 2012/0074276 | A1 * | 3/2012 | Hand et al. | 248/205.6 |
| 2012/0168472 | A1 * | 7/2012 | Mathews | 224/162 |
| 2012/0180189 | A1 * | 7/2012 | Crye | A41D 13/0007 2/102 |

* cited by examiner

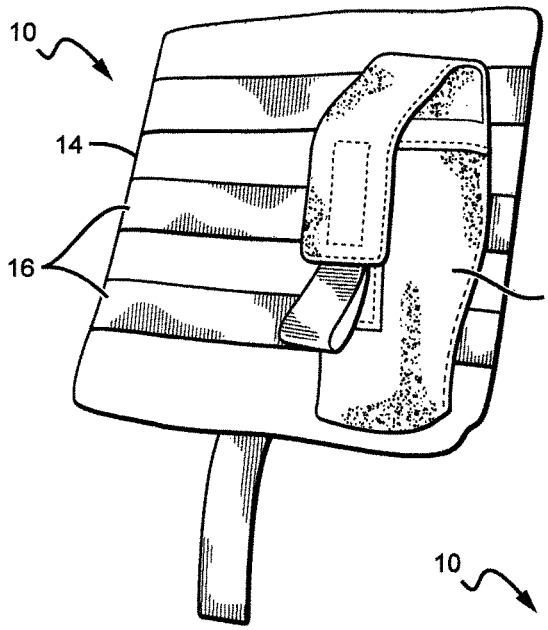
FIG. 1
FIG. 2
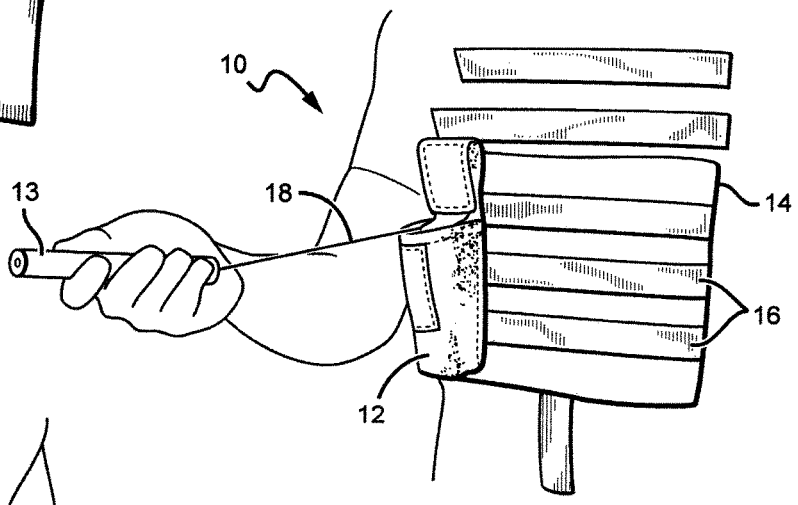
FIG. 4
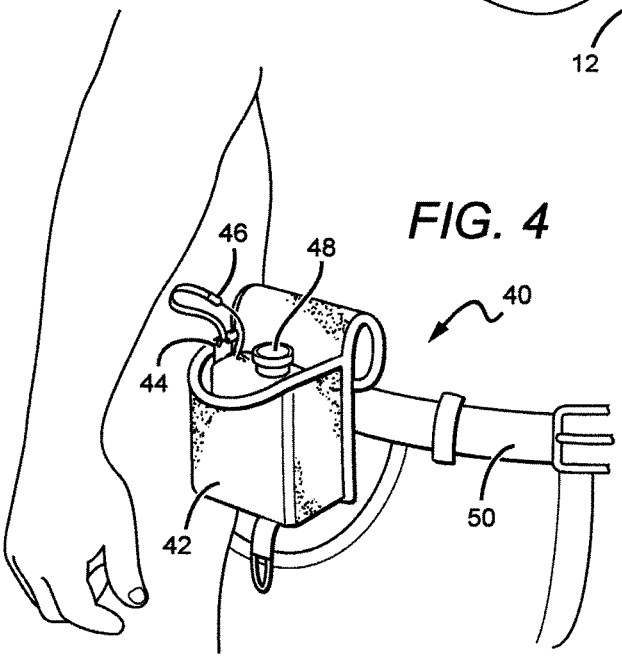

POUCH OR HOLSTER COUPLED WITH A RETRACTING DEVICE

This application claims the benefit of U.S. Provisional Patent Application Ser. No. 61/587,060, filed on Jan. 16, 2012.

BACKGROUND OF THE INVENTION

Field of the Invention

The present invention is generally directed to a holstering and retracting device system that can be used for securing a piece of gear or instrument when not in use.

Description of the Related Art

Holsters are a common use item for the securing of gear to a person to provide a way of holding such a device when not in use. They range from holsters for side arms, phones, binoculars, GPS units, dog training transmitters and an extensive list of items.

Holsters of various designs are commonly used in outdoors, industrial and military applications when the use has devices or gear that is too numerous to hold, or to provide other storage locations when the device is not in use. Holsters however do not provide a method for preventing the loss or damage of a piece of gear or instrument should it come separated from or fall out of the holster. The holster also does not provide any protection should the user drop the device or gear during use.

Lanyards have been developed that can provide added security for preventing loss and damage of the gear or instrument should it become dislodged from the holster or when the gear or instrument is removed from the holster during use. Retracting devices have also been developed that can be used in connection with lanyards. Retractable tethering devices are currently being attached to a person through use of common art attachment mechanisms such as Snap Clips, Velcro Straps, Pin Mounting Systems, Bracket Mounting devices and Belt Clipping devices. Examples of these retractable devices can be seen in U.S. Pat. Nos. 6,966,519, 7,478,776, and 7,665,684, all to Salentine and Collin, and all assigned to Hammerhead Industries, Inc., the same assignee as the present application.

Some systems have been developed comprising a retracting device coupled with a holster to provide the tethering security when the device is in use. For these systems, two items must be attached to a person and coupled together in order to provide the desired protection, in that the device is tethered during use but secured in a holster when not in use to eliminate the dangling and provide further protection of the device.

Different applications have been developed for hiding a retracting device into a pocket. In these cases, a retractor can be arranged in a pocket, and an eyelet or reinforced button hole can be constructed at or around the pocket to allow the retracting cable/line to exit from the pocket to attach to a piece of gear or instrument. Many of such applications exist in the SCUBA, Fly Fishing, Outdoors and Military markets, and many of these applications have been developed by the assignee of the present application.

These systems have worked well for integrating retracting devices into such things as backpacks, SCUBA BCD's, Fly Fishing waders and vests, and hunting jackets. However, these systems may not provide a securing mechanism for the gear or instrument such that when the gear or instrument is not in use, to prevent dangling and undesirable movement of the gear or instrument. Attempts have been made to position a retracting device in a holster such that the gear is retracted into the holster. In order to do this extra length would need to be added to the holster in order to fit both the gear and the retracting device in which the added length has been undesirable.

Alternatively, the retracting device has been placed behind the holster with the line entering the bottom of the holster and wraping 180-degrees upward through the holster. This design has significant undesirable line wear issues. Further, depending on the size of the holster, it is not possible to grab the retracting connector buried in the bottom of the holster.

SUMMARY OF THE INVENTION

The present invention is generally directed to a holstering retractor device or system for securing a piece of gear or instrument when not in use, such that said gear or instrument does not have to be held or slid into a pocket. These systems are coupled with a retracting device, integrated into the holster, such that if said instrument or device pops out of holster, or is dropped while in use, it is not lost or damaged. The present invention is also directed to systems utilizing the holster retractors, such as vest system having the holster retractor mounted to the vests.

One embodiment of a holster retractor system according to the present invention comprises a holster/pouch sized to hold a hand operable device. The holster/pouch has an opening for removal and replacement of the hand operable device. A retractor is mounted to or within the holster/pouch, said retractor having a line capable of extending from and retracting back into the retractor. The line can be connected to the hand operable device, and the retractor is positioned in relation to a holster/pouch opening such that the line extends from the retractor in general alignment with the retractor when the hand operable device is removed straight out of the holster/pouch.

Another embodiment of a holster retractor system according to the present invention comprises a holster/pouch mounted to a user and sized to hold a user operable device. The holster/pouch can have an opening for removal and replacement of said user operable device, and a retractor mounted to or within the holster/pouch. The retractor can have a line connected to the user operable device, with the said line capable of extending from the retractor under a pulling force from the user, and retracting back into the retractor when said pulling force is released. The line can be arranged such that it does not fully retract into the retractor when said pulling force is released.

One embodiment of a vest system according to the present invention comprises a web strap system for the mounting of accessories to the vest. The holster retractor comprises a holster/pouch sized to hold a hand operable device, with the holster/pouch having an opening for removal and replacement of the hand operable device. The holster/pouch can comprise an attachment mechanism for mounting to the web strap system. A retractor is mounted to or within the holster/pouch, with the retractor having a line capable of extending from and retracting back into the retractor. The line can be connected to the hand operable device, wherein said retractor is positioned in relation to the holster/pouch such that the line extends from the retractor in general alignment with the retractor when the hand operable device is removed straight out of the holster/pouch.

These and other further features and advantages of the invention would be apparent to those skilled in the art from the following detailed description, taken together with the accompanying drawings, in which:

BRIEF DESCRIPTION OF THE DRAWINGS

FIG. 1 is a side perspective view of one embodiment of a holster retractor system according to the present invention, mounted to a web strap;

FIG. 2 is another side perspective view of the holster retractor system shown in FIG. 1;

FIG. 4 is a side perspective view of another embodiment of a holster retractor system according to the present invention, mounted to a user's belt;

DETAILED DESCRIPTION OF THE INVENTION

Figure 5:
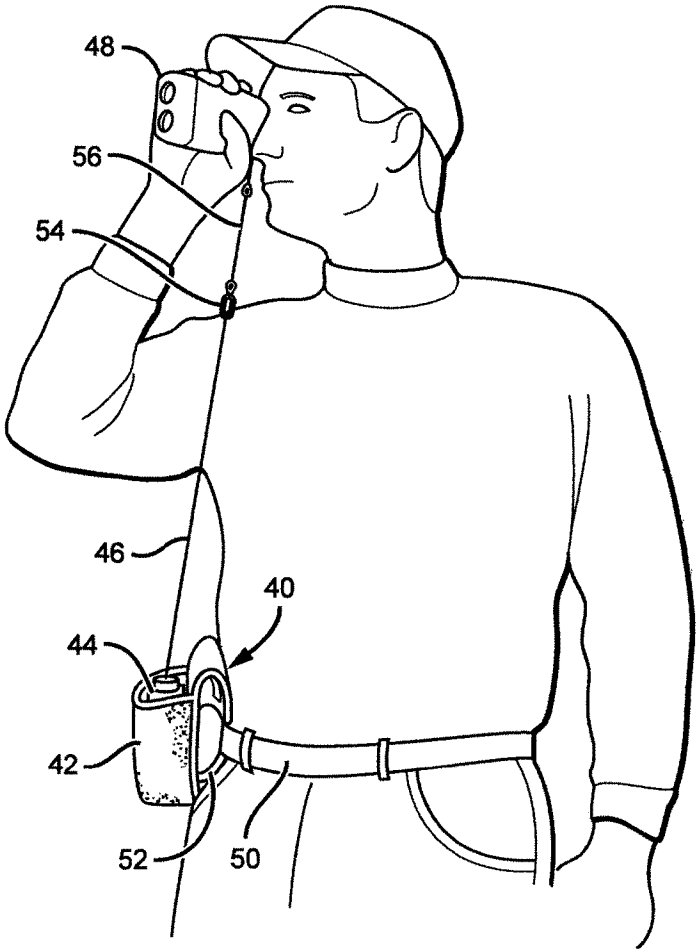
FIG. 5 is another side perspective view of the holster retractor system shown in FIG. 4.

The present invention is directed toward marrying the two items (holster and retractable lanyard) such that one item is attached to the person and provides an efficient and low profile system to secure gear and minimize entanglement. Different embodiments of the invention provide a holster for the securing of the device when not in use, to hold the device and protect the device from loss and damage and eliminate dangling of the device.

Further, said invention integrates a retracting device positioned in the holster such that the gear or instrument can be easily inserted or removed from the holster. When the gear or instrument is removed from the holster, the retracting device provides a security tether to prevent the gear or instrument from loss or damage. If the user lets go of the instrument it is retracted back to the holster, thereby freeing the users hands, while still tethered to the user. The gear or instrument can later be inserted into the holster for proper storage when convenient.

The present invention is described herein with reference to certain embodiments, but it is understood that the invention can be embodied in many different forms and should not be construed as limited to the embodiments set forth herein. It is further understood that different embodiments can comprise different materials arranged in different ways, and can comprise different features. Different embodiments can also be arranged for mounting to different types of apparatus beyond vests, and can be arranged to attach to different features of the vests.

It will be understood that when an element is referred to as being "on" or "in contact with" another element, it can be directly on, or in contact with the other element or intervening elements may be present. In contrast, when an element is referred to as being "directly on", or "directly in contact with" another element, there are no intervening elements present. Although the terms first, second, etc. may be used herein to describe various elements, and/or sections, these elements and/or sections should not be limited by these terms. These terms are only used to distinguish one element, or section from another element, or section. Thus, a first element or section discussed herein could be termed a second element, or section without departing from the teachings of the present invention.

Embodiments of the invention are described herein with reference to perspective view illustrations that are schematic illustrations of an embodiment of the invention. As such, the actual thickness of components can be different, and variations from the shapes of the illustrations as a result, for example, of manufacturing techniques and/or tolerances are expected. Embodiments of the invention should not be construed as limited to the particular shapes as illustrated herein but are to include deviations in shapes that result, for example, from manufacturing. A region illustrated or described as square or rectangular will typically have rounded or curved features due to normal manufacturing tolerances. Thus, the regions illustrated in the figures are schematic in nature and their shapes are not intended to illustrate the precise shape of a region of a device and are not intended to limit the scope of the invention.

Figure 3:
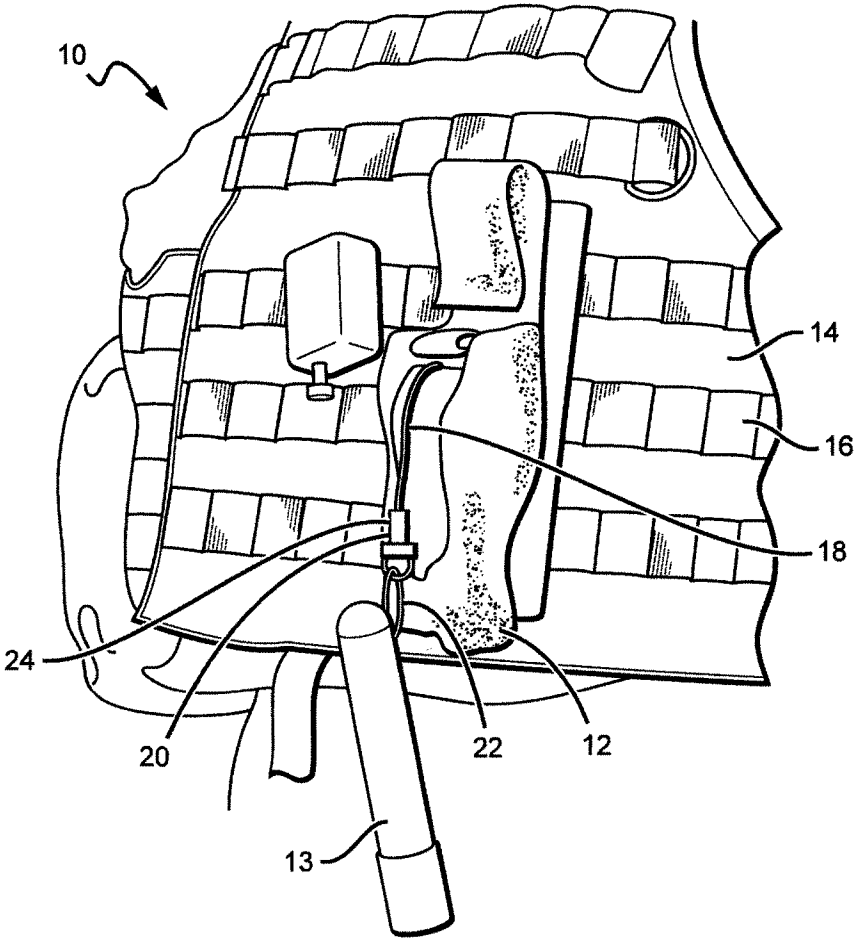
FIG. 3 is still another side perspective view of the holster retractor system shown in FIG. 1.

FIGS. 1-3 show one embodiment of a holster retractor system 10 according to the present invention that comprises a holster or pouch 12 mounted to a user. The holster/pouch 12 can be many different shapes and sizes, and can be made of many different materials, such as a woven nylon material. The present invention can be used with many different pieces of gear or accessories, including but not limited to hand held accessories such as a flashlight, laser pointer, medic shear, compass, handgun, binoculars knife, GPS, FRS radio, among other devices.

The holster retractor system 10 can have a mounting mechanism (not shown) that can be used to mount the holster retractor system to a user, and in the embodiment shown the holster can be mounted to vest 14 that can be worn by the user, with the vest shown being similar to a Modular Lightweight Load-carrying Equipment (MOLLE) vest having a strap mounting system 16. The holster retractor can be mounted to the strap mounting system 16 using known mounted mechanisms such as a belt clip, snap clip or strap loop.

The retract system 10 can comprise a retractor (not shown) that can be held in a pocket that can be inside or outside of the holster/pouch 12 and can be arranged in different orientations. In some embodiments of holster retractor 10 the pocket can be at or near the top of the holster/pouch 12, at or near its opening. The retractor can house a line 18 (shown in FIGS. 2 and 3) that protrudes from the retractor through a hole in its housing. The housing can also include an internal mechanism that biases the line to retract back into the housing. Many different biasing mechanisms can be used, with some embodiment utilizing a spring. A connector mechanism 20 (shown best in FIG. 3) can be attached to the end of the line 18 and can be used to connect to the accessory 13, which in this embodiment comprises a flashlight. The line 18 can be pulled and extended from the retractor by the user against the bias of the internal biasing mechanism, and automatically retracts into the retractor when the pulling force is released. Lines of different length can be used, with one embodiment having a tether that extends approximately 36 inches from the retractor. Other embodiments can extend to lengths greater than 36 inches, while others can extend less. The internal spring can have different levels of retraction force, with one embodiment having a retraction force of approximately 6 ounces. Other embodiments can have a lower retraction force, while still other embodiments can have a greater retraction force, such as 12 or 18 ounces, or more.

Many different connector mechanisms can be used, with the embodiment shown comprising an attachment ring 22 for holding an accessory, and a quick release mechanism 24 that securely holds the accessory to the holster retractor 10. The quick release mechanism can also be operated by the user for disengaging the accessory from the holster retractor 10.

A reinforced button loop or eyelet can be included for the retractor's line to extend and the holster can be reinforced near the retraction of the line, to allow for the holster to withstand repeated extensions and retractions of the line from the housing. A coupling device is included on the retractor for attachment to the gear, instrument or accessory, which also maintains an easy method for removing said gear or instrument.

Different embodiments according to the present invention can be arranged to work in different ways. In some embodiments, the retractor can be arranged such that retraction force of the retractor on the line 18 pulls the accessory into the holster/pouch 12. In still other embodiments, the present invention can be arranged so that it does not retract the gear or accessory into the holster/pouch 12 when the gear or instrument is released by the user. These embodiments instead couple the two items (holster and gear) in such a manner as to allow easy stowage and removal of the gear while attached to a retracting device. In these embodiments, if the accessory is released from an extended position, it can retract back to the holster but will not be drawn back into the fully holstered location within the holster/pouch. Instead, the user may need to physically stow the accessory when not in use. This arrangement has been found to be desirable in equipment intensive activities such as for the military, hunting and industrial, where it is common to return an unused piece of gear or instrument back to its storage location. However, in the case where it is not possible to stow the gear or instrument, it can be simply released without the fear of loss or damage.

In some embodiments, the retractor is arranged such that the line 18 extends from the holster/pouch 12 at or near the opening of the pouch or holster. This allows for the line 18 to extend from holster/pouch in general alignment with the retractor and/or in general alignment with the holster/pouch. In these embodiments, the retractor can be mounted to one of the side surfaces of the holster/pouch 12, either inside or outside of the pouch. In other embodiments, the retractor can be on the bottom of the holster/pouch with the line extending from the retractor with minimal stresses, such as out the side surface of the retractor housing. These arrangements allow for extension and retraction of the line 18 to and from the retractor while reducing the stresses and wear on the line 18. Further the retractor's pocket can be arranged so that it does not inhibit the storage space of the holster for the gear or instrument.

It is understood that the different embodiments can be arranged with many different features beyond those described above. The holster retractor 10 can comprise a cover flap to cover the opening of the holster/pouch 12, with the cover or flap being held in place by a button, snap, clip or by hook and loop device such as Velcro. The holster/pouch can also comprise a reinforced area to prevent or reduce wear on the pouch when the accessory is dangling.

Figure 6:
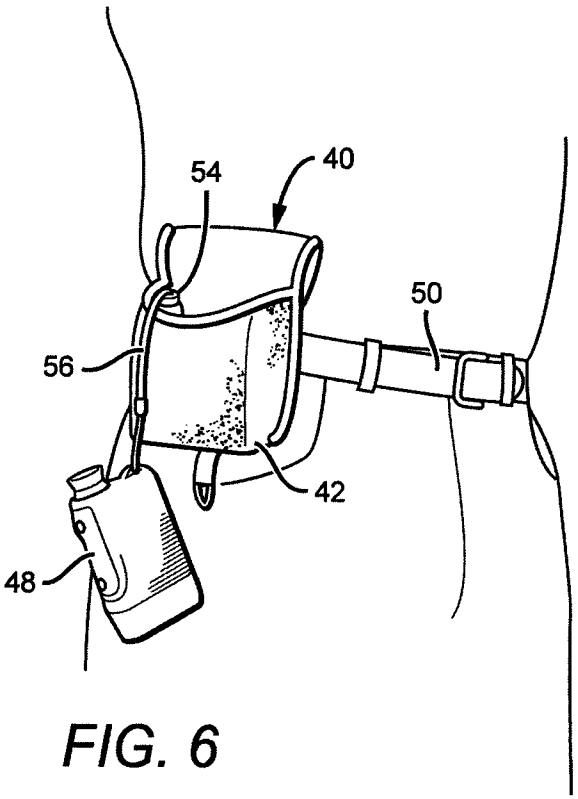
FIG. 6 is still another side perspective view of the holster retractor system shown in FIG. 4.

FIGS. 4-6 show another embodiment of a holster retractor system 40 according to the present invention comprising a holster/pouch 42, a retractor 44, a line 46 and an accessory 48. As mentioned above, the holster/pouch 42 can be made of many different materials and can have many different shapes and sizes to hold different types of accessories. In the embodiment shown, the holster/pouch 42 is arranged so that it can be mounted to the belt 50 of a user. The back of the holster/pouch 42 can have many different mechanisms for mounting to a belt, such as a clip or snap, with the embodiment shown having a belt loop 52 (shown in FIG. 5) for the belt to pass through.

Like the embodiment above, the accessory 48 can comprise many different devices, with the embodiment shown comprising a range finder. Referring to FIG. 5, the user can grasp and pull the accessory from the holster/pouch 42 and can extend the line 46 against the urging of the retractor's internal spring (not shown). The line 46 should be long enough to allow for convenient extension of the line 46 from the retractor 44 so that user can maneuver the accessory to eye level. When the user is done using the accessory 48, the pulling force can be released and the accessory can be guided back to the holster/pouch 42. This can either be done while the user still grasps the accessory 48, or the accessory 48 can be released by the user. The line 46 generally extends from the holster/punch is alignment with the retractor 44 when the accessory is removed straight out the opening of the holster/pouch. This reduces and minimizes the bends in the line 46 as it is extended and retracted to and from the retractor to minimize stress and wear on the line 46. This can increase the reliability of and extend the life of the holster retractor systems according to the present invention.

The line 46 can also comprise a stop 54 and a lanyard 56. The stop 54 can be sized to such that it is bigger than the hole in the retractor housing that the line 46 extends/retracts through, such that the stop prevents the line from being fully retracted into the retractor housing. The lanyard 56 can be attached between the accessory 48 and the stop 54, and can be made of different flexible and durable materials, such a nylon cord.

As best shown in FIG. 6, when the line 46 is retracted into the retractor 44, the stop 54 is at the retractor housing and the lanyard 56 provides a flexible length between the retractor 44 and the accessory 48. This allows for the accessory to hang next to the holster/pouch by the lanyard 56. With this arrangement, if the accessory is dropped during use, or dislodges from the holster/pouch 42, the accessory does not drop to the ground, but remains with the holster retractor system 40 by the lanyard connection. This arrangement allows for convenient use of the accessory 48, while at the same time preventing damage to and loss of the accessory 48 during use.

Figure 7:
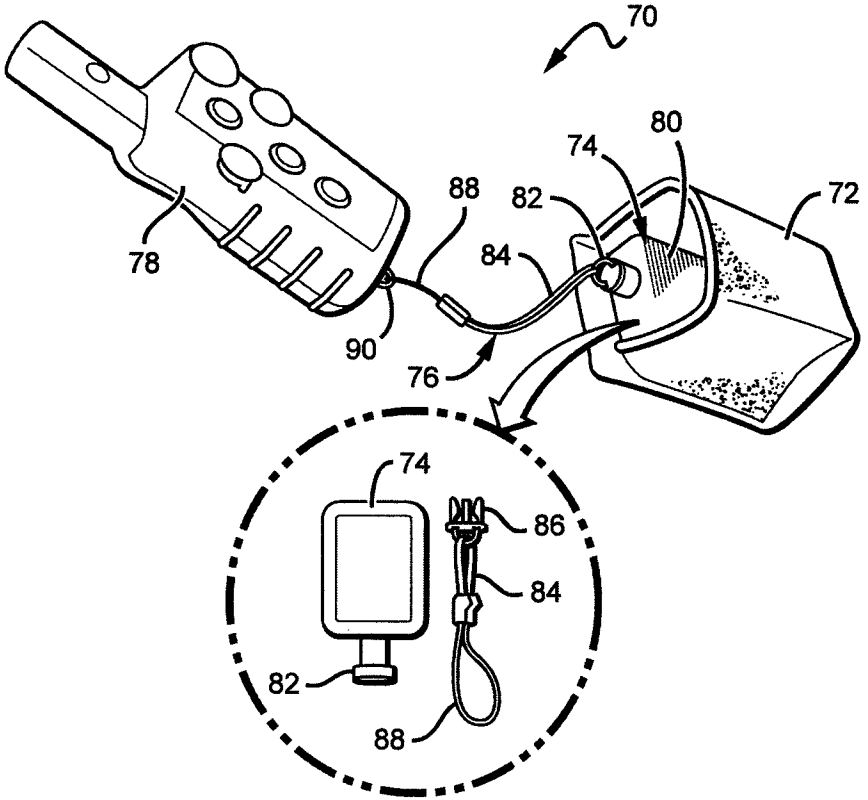
FIG. 7 is a perspective view of still another embodiment of a holster retractor system according to the present invention.

FIG. 7 shows another embodiment of a holster retractor system 70 according to the present invention comprising a holster/pouch 72, retractor 74, line 76 and accessory 78. The accessory 78 in this embodiment can comprise a communication device, such as radio or cell phone, and the holster/pouch can be sized to hold the accessory. Like the embodiments above, the retractor 74 can be arranged inside or outside of the holster/pouch 72, and can be held in a pocket 80 with the opening for the line 76 directed out the opening of holster/pouch. The holster/pouch can be mounted to a strap system or belt as discussed above. The line 76 can also comprise a stop 82 and a lanyard 84 as discussed above, with the stop preventing the line from fully retracting into the retractor 74. The lanyard 84 also provides the durable and flexible length that allows for the accessory 78 to hang from the holster/pouch 72 when the accessory 78 is released or dropped.

The lanyard 84 can also comprise a quick release mechanism 86 that cooperates with the stop 82 to attach the lanyard to the stop 82. The quick release mechanism 86 comprises opposing tabs that can be compressed by the user to disengage the mechanism 86 from the stop 82. This allows for the user to quickly and easily disconnect the accessory 78 from the retractor 74. The lanyard 84 can also comprise a connecting loop 88 of thin but durable line that can be used for connecting to and accessory 78. The connecting loop 88 can be fed through a connecting hole 90 and the lanyard can then be fed back through the connecting loop 88 as is known in the art.

While different embodiments of the invention have been shown and described, numerous variations and alternate embodiments will occur to those skilled in the art, such as utilizing the present invention for attaching to many different devices and for use with many different accessories. Such variations and alternate embodiments are contemplated, and can be made without departing from the spirit and scope of the invention as described herein.

We claim:

1. A holster retractor system, comprising:

a holster/pouch sized to simultaneously hold a hand operable device and a retractor within a common compartment, said compartment having an opening for removal and replacement of said hand operable device;

said retractor mounted within said compartment, said retractor comprising a housing and a line capable of extending from and retracting back into a hole on said housing, said line capable of connecting to said hand operable device, wherein said retractor is positioned in relation to said holster/pouch opening such that said line extends from said retractor in general alignment with said retractor when said hand operable device is connected to said line and removed straight out of said holster/pouch, said pouch comprising a reinforced area to resist wear from repeated extensions and retractions of said line; and a stop on said line, wherein said stop is sized such that it is larger than said hole on said housing, preventing a portion of said line from retracting back into said holster/pouch.

2. The system of claim 1, wherein said retractor comprises a retraction mechanism to bias retraction of said line into a housing of said retractor.

3. The system of claim 2, wherein said retraction mechanism comprises a spring.

4. The system of claim 1, wherein said holster/pouch comprises an attachment mechanism for attaching to a user.

5. The system of claim 4, wherein said attachment mechanism allows for attachment to a vest.

6. The system of claim 4, wherein said attachment mechanism allows for attachment to a web strap system.

7. The system of claim 4, wherein said attachment mechanism comprises a belt loop.

8. The system of claim 1, wherein said line is connected to said hand operable device by a lanyard.

9. The system of claim 1, wherein said line is connected to said hand operable device by a disconnect mechanism.

10. The system of claim 1, wherein said line is capable of extending from said retractor under a pulling force from said user.

11. The retractor system of claim 1, wherein said line is capable of retracting back into a housing of said retractor when said pulling force is released.

12. The retractor system of claim 11, wherein said line does not fully retract into said housing when said pulling force is released.

13. The retractor system of claim 1, wherein said line is coupled to a disconnect mechanism and wherein said disconnect mechanism prevents said line from being fully retracted into a housing of said retractor.

14. The system of claim 1, wherein the retractor is integrated into the holster/pouch.

15. A holster retractor system, comprising:

a holster/pouch mounted to a user and sized to simultaneously hold a user operable device and a retractor within a common compartment, said compartment having an opening for removal and replacement of said user operable device; and said retractor mounted within said compartment, said retractor having an internal biasing mechanism, said retractor comprising a housing and a line capable of connecting to said user operable device, said line capable of extending from said retractor through a hole on said housing against the force of said internal biasing mechanism under a pulling force from the user, and retracting back into said hole of said housing when said pulling force is released, said internal biasing mechanism being strong enough to draw back said user operable device to compartment when said user operable device is released, said line comprising a stop sized such that it is larger than said hole on said housing, such that a portion of said line does not retract into said holster/pouch when said pulling force is released.

16. The system of claim 15, wherein said user operable device is arranged to hang from said holster/pouch by a length of said line when said pulling force is removed.

17. The system of claim 15, wherein said line further comprises a lanyard that provides the hanging length of line.

18. The system of claim 17, wherein said lanyard does not retract into said retractor when said pulling force is released.

19. The system of claim 17, wherein said lanyard comprises a quick release mechanism.

20. The system of claim 15, wherein said retractor is positioned in relation to said holster/pouch such that said line extends from said retractor in general alignment with said retractor when said user operable device is connected to said line and removed straight out of said holster/pouch.

21. The system of claim 20, wherein said retractor is positioned adjacent to said holster/pouch opening.

22. The system of claim 15, wherein the retractor is integrated into the holster/pouch.

23. A vest, comprising:

a web strap system for the mounting of accessories to said vest;

a holster/pouch sized to simultaneously hold a hand operable device and a retractor within a common compartment, said compartment having an opening for removal and replacement of said hand operable device, said holster/pouch comprising an attachment mechanism for mounting to said web strap system;

said retractor mounted within said compartment, said retractor comprising a housing and a line capable of extending from and retracting back into a hole on said housing, said line capable of connecting to said hand operable device, wherein said retractor is positioned in relation to said holster/pouch such that said line extends from said retractor in general alignment with said retractor when said hand operable device is connected to said line and removed straight out of said holster/pouch; and a stop on said line, wherein said stop is sized such that it is larger than said hole on said housing, preventing a portion of said line from retracting back into said holster/pouch.

24. The vest of claim 23, wherein the retractor is integrated into the holster/pouch.

* * * * *